US011969128B2

(12) United States Patent
Hofmann

(10) Patent No.: US 11,969,128 B2
(45) Date of Patent: Apr. 30, 2024

(54) SYSTEM AND METHOD FOR DETECTING UNINTENTIONAL BUTTON ACTIVATION AND IMPLEMENTING AN AUTOMATIC RESPONSE

(71) Applicant: Haier US Appliance Solutions, Inc., Wilmington, DE (US)

(72) Inventor: Adam Christopher Hofmann, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 17/675,201

(22) Filed: Feb. 18, 2022

(65) Prior Publication Data

US 2023/0263360 A1 Aug. 24, 2023

(51) Int. Cl.
*A47L 15/00* (2006.01)
*A47L 15/42* (2006.01)

(52) U.S. Cl.
CPC ..... *A47L 15/0049* (2013.01); *A47L 15/0063* (2013.01); *A47L 15/4293* (2013.01); *A47L 2301/04* (2013.01); *A47L 2501/26* (2013.01)

(58) Field of Classification Search
None
See application file for complete search history.

(56) References Cited

U.S. PATENT DOCUMENTS

| | | | |
|---|---|---|---|
| 8,902,172 | B2 | 12/2014 | Peng et al. |
| 11,009,989 | B2 | 5/2021 | Munemoto |
| 2011/0181516 | A1 | 7/2011 | Mallory et al. |
| 2016/0077664 | A1 | 3/2016 | Harrison et al. |
| 2021/0157408 | A1* | 5/2021 | Karimi Eskandary . G06F 3/016 |

FOREIGN PATENT DOCUMENTS

| | | |
|---|---|---|
| EP | 3195095 B1 | 4/2021 |

* cited by examiner

*Primary Examiner* — Rita P Adhlakha
(74) *Attorney, Agent, or Firm* — Dority & Manning, P.A.

(57) ABSTRACT

A dishwasher appliance is provided including a door pivotally mounted to a cabinet to provide selective access to a wash chamber and a user interface panel mounted to the door. A controller is in operative communication with the user interface panel and is configured to detect an abnormal button interaction with the user interface panel, determine that at least one cycle operating parameter has changed in response to the abnormal button interaction, and implement a responsive action, such as providing a user notification, seeking user confirmation, and reverting to prior settings if the abnormal button interaction was unintentional and resulted in a change in the cycle operating parameters.

18 Claims, 4 Drawing Sheets

SYSTEM AND METHOD FOR DETECTING UNINTENTIONAL BUTTON ACTIVATION AND IMPLEMENTING AN AUTOMATIC RESPONSE

FIELD OF THE INVENTION

The present subject matter relates generally to dishwasher appliances, and more particularly, to systems and methods for addressing appliance operation after unintentional interactions with the user interface panel.

BACKGROUND OF THE INVENTION

Dishwasher appliances commonly have doors that pivot between an open and closed position to provide selective access to an internal wash chamber. In addition, these appliances commonly have user interface or control panels mounted to the door for convenient user interaction. These user interface panels may be positioned on a top edge of the door, on a front surface of the door, on the handle, etc.

While the position of these user interface panels provides for convenient user interaction and control of the appliance and associated operating cycles or parameters, unintentional or inadvertent interaction with these panels is a common issue. For example, a user may inadvertently push a button while opening or closing the door, a shin may accidently contact the user interface panel when the door is open, a pet may unintentionally interact with the panel, etc.

Notably, inadvertent adjustment of operating cycle parameters may have a significant effect on the performance of the dishwasher and the user's satisfaction with the appliance. For example, there are cycles and cycle options that are designed for low soil (e.g., light cycle, upper rack wash, etc.) which can have significant performance issues and create consumer dissatisfaction if unintentionally run while loading dishes with a normal/high soil load. In addition, there are cycles and cycle options that are designed for longer cycle time, water usage, and energy usage (e.g., sanitization option, heavy cycle, etc.) which can have consumer dissatisfaction if unintentionally activated. If the consumer unintentionally de-activates a dry option, then there is high likelihood that there will be dissatisfaction with respect to drying performance.

Accordingly, a dishwasher appliance that is capable of detecting and correcting for inadvertent interactions with the user interface panel would be useful. More specifically, a method for intelligently setting cycle options and parameters based on intentional versus unintentional button user inputs would be particularly beneficial.

BRIEF DESCRIPTION OF THE INVENTION

Aspects and advantages of the invention will be set forth in part in the following description, or may be obvious from the description, or may be learned through practice of the invention.

In one exemplary embodiment, a dishwasher appliance is provided defining a vertical direction, a lateral direction, and a transverse direction. The dishwasher appliance includes a wash tub positioned within a cabinet and defining a wash chamber, a door pivotally mounted to the cabinet to provide selective access to the wash chamber, a user interface panel mounted to the door, and a controller in operative communication with the user interface panel. The controller is configured to detect an abnormal button interaction with the user interface panel, determine that at least one operating parameter has changed in response to the abnormal button interaction, and implement a responsive action in response to determining that the at least one operating parameter has changed in response to the abnormal button interaction.

In another exemplary embodiment, a method of operating a dishwasher appliance is provided. The dishwasher appliance includes a user interface panel mounted to a door. The method includes detecting an abnormal button interaction with the user interface panel, determining that at least one operating parameter has changed in response to the abnormal button interaction, and implementing a responsive action in response to determining that the at least one operating parameter has changed in response to the abnormal button interaction.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
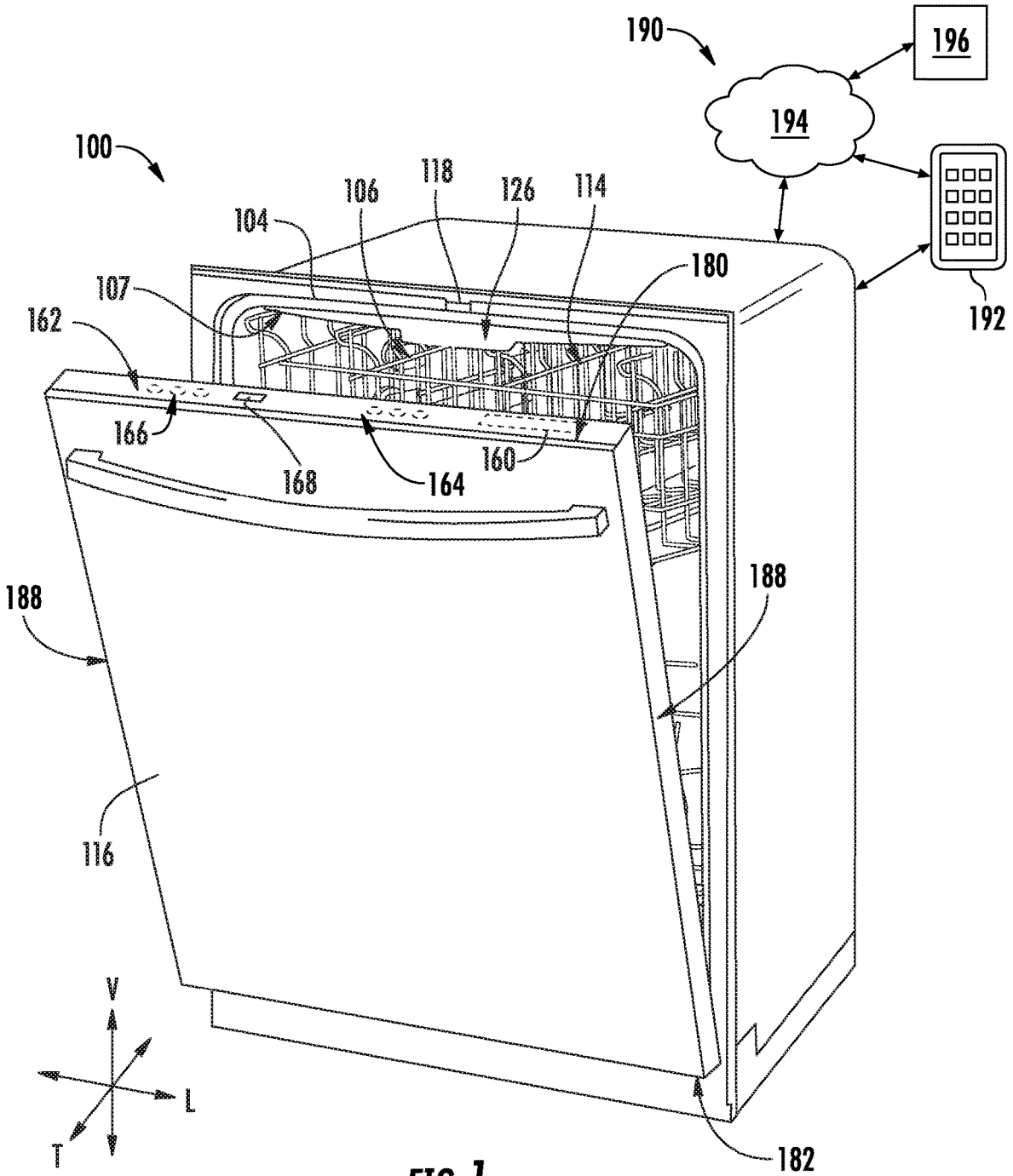
FIG. 1 provides a perspective view of a dishwasher appliance, including a dishwasher door according to exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. In addition, the term "or" is generally intended to be inclusive (i.e., "A or B" is intended to mean "A or B or both"). Furthermore, as used herein, terms of approximation, such as "approximately," "substantially," or "about," refer to being within a ten percent margin of error.

Figure 2:
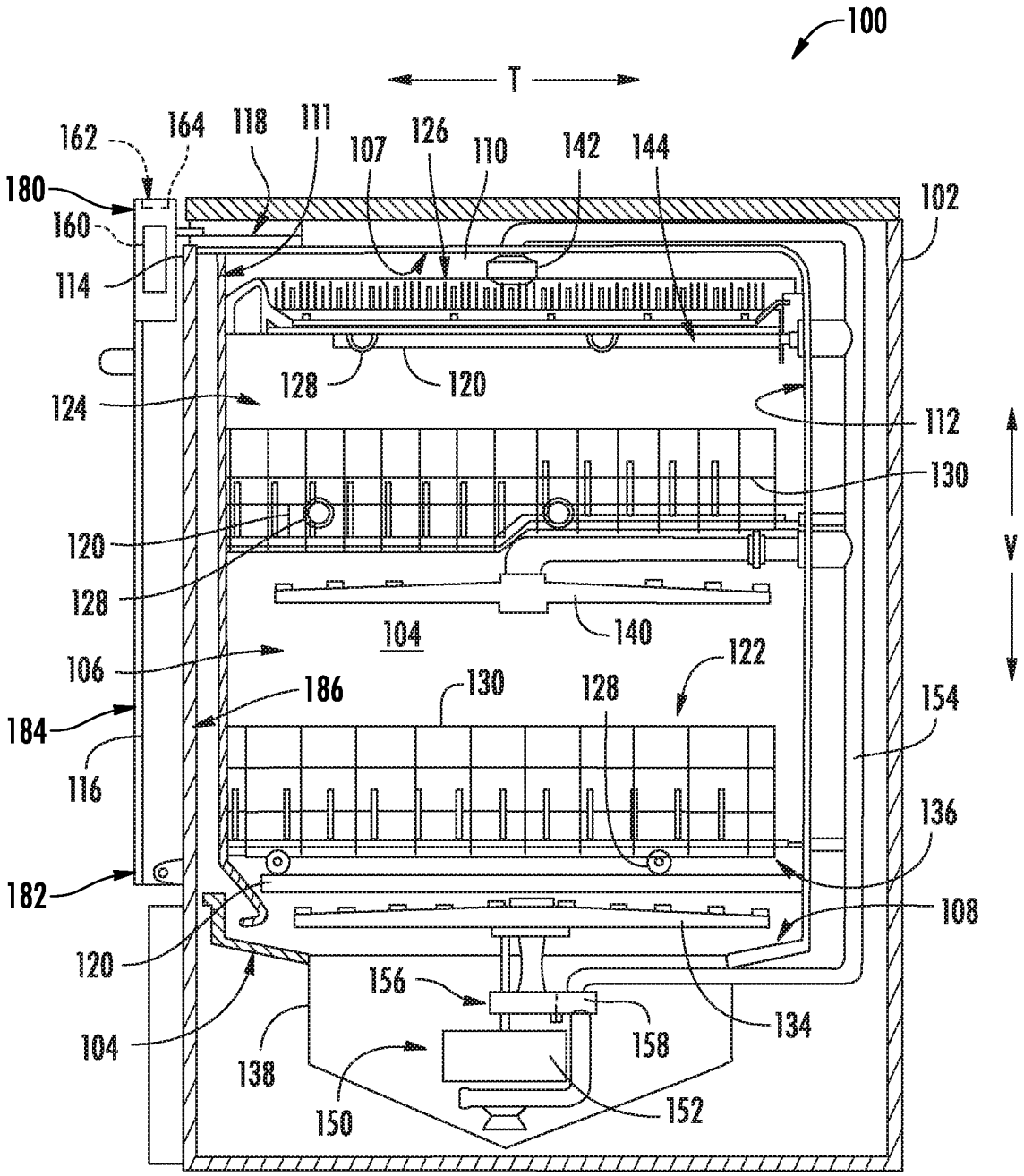
FIG. 2 provides a cross-sectional side view of the exemplary dishwashing appliance of FIG. 1.

FIGS. 1 and 2 depict an exemplary domestic dishwashing appliance or dishwasher 100 that may be configured in accordance with aspects of the present disclosure. For the particular embodiment of FIGS. 1 and 2, the dishwasher 100 includes a cabinet 102 having a tub 104 therein that defines a wash chamber 106. As shown, tub 104 extends between a top 107 and a bottom 108 along a vertical direction V, between a pair of side walls 110 along a lateral direction L, and between a front side 111 and a rear side 112 along a transverse direction T. Each of the vertical direction V, lateral direction L, and transverse direction T are mutually orthogonal to one another.

The tub 104 includes a front opening 114 and a door 116 hinged at its bottom for movement between a normally closed vertical position (shown in FIG. 2), wherein the wash chamber 106 is sealed shut for washing operation, and a horizontal open position for loading and unloading of articles from the dishwasher 100. According to exemplary embodiments, dishwasher 100 further includes a door closure mechanism or assembly 118 that is used to lock and unlock door 116 for accessing and sealing wash chamber 106.

As illustrated in FIG. 2, tub side walls 110 may accommodate a plurality of rack assemblies. More specifically, guide rails 120 may be mounted to side walls 110 for supporting a lower rack assembly 122, a middle rack assembly 124, and an upper rack assembly 126. As illustrated, upper rack assembly 126 is positioned at a top portion of wash chamber 106 above middle rack assembly 124, which is positioned above lower rack assembly 122 along the vertical direction V. Each rack assembly 122, 124, 126 is adapted for movement between an extended loading position (not shown) in which the rack is substantially positioned outside the wash chamber 106, and a retracted position (shown in FIGS. 1 and 2) in which the rack is located inside the wash chamber 106. This is facilitated, for example, by rollers 128 mounted onto rack assemblies 122, 124, 126, respectively. Although a guide rails 120 and rollers 128 are illustrated herein as facilitating movement of the respective rack assemblies 122, 124, 126, it should be appreciated that any suitable sliding mechanism or member may be used according to alternative embodiments.

Some or all of the rack assemblies 122, 124, 126 are fabricated into lattice structures including a plurality of wires or elongated members 130 (for clarity of illustration, not all elongated members making up rack assemblies 122, 124, 126 are shown in FIG. 2). In this regard, rack assemblies 122, 124, 126 are generally configured for supporting articles within wash chamber 106 while allowing a flow of wash fluid to reach and impinge on those articles (e.g., during a cleaning or rinsing cycle). According to another exemplary embodiment, a silverware basket (not shown) may be removably attached to a rack assembly (e.g., lower rack assembly 122) for placement of silverware, utensils, and the like, that are otherwise too small to be accommodated by rack 122.

Dishwasher 100 further includes a plurality of spray assemblies for urging a flow of water or wash fluid onto the articles placed within wash chamber 106. More specifically, as illustrated in FIG. 2, dishwasher 100 includes a lower spray arm assembly 134 disposed in a lower region 136 of wash chamber 106 and above a sump 138 so as to rotate in relatively close proximity to lower rack assembly 122. Similarly, a mid-level spray arm assembly 140 is located in an upper region of wash chamber 106 and may be located below and in close proximity to middle rack assembly 124. In this regard, mid-level spray arm assembly 140 may generally be configured for urging a flow of wash fluid up through middle rack assembly 124 and upper rack assembly 126. Additionally, an upper spray assembly 142 may be located above upper rack assembly 126 along the vertical direction V. In this manner, upper spray assembly 142 may be configured for urging or cascading a flow of wash fluid downward over rack assemblies 122, 124, and 126. As further illustrated in FIG. 2, upper rack assembly 126 may further define an integral spray manifold 144, which is generally configured for urging a flow of wash fluid substantially upward along the vertical direction V through upper rack assembly 126.

The various spray assemblies and manifolds described herein may be part of a fluid distribution system or fluid circulation assembly 150 for circulating water and wash fluid in the tub 104. More specifically, fluid circulation assembly 150 includes a pump 152 for circulating water or wash fluid (e.g., detergent, water, or rinse aid) in the tub 104. Pump 152 may be located within sump 138 or within a machinery compartment located below sump 138 of tub 104, as generally recognized in the art. Fluid circulation assembly 150 may include one or more fluid conduits or circulation piping for directing water or wash fluid from pump 152 to the various spray assemblies and manifolds. For example, as illustrated in FIG. 2, a primary supply conduit 154 may extend from pump 152, along rear 112 of tub 104 along the vertical direction V to supply wash fluid throughout wash chamber 106.

As illustrated, primary supply conduit 154 is used to supply wash fluid to one or more spray assemblies (e.g., to mid-level spray arm assembly 140 and upper spray assembly 142). However, it should be appreciated that according to alternative embodiments, any other suitable plumbing configuration may be used to supply wash fluid throughout the various spray manifolds and assemblies described herein. For example, according to another exemplary embodiment, primary supply conduit 154 could be used to provide wash fluid to mid-level spray arm assembly 140 and a dedicated secondary supply conduit (not shown) could be utilized to provide wash fluid to upper spray assembly 142. Other plumbing configurations may be used for providing wash fluid to the various spray devices and manifolds at any location within dishwasher appliance 100.

Each spray arm assembly 134, 140, 142, integral spray manifold 144, or other spray device may include an arrangement of discharge ports or orifices for directing wash fluid received from pump 152 onto dishes or other articles located in wash chamber 106. The arrangement of the discharge ports, also referred to as jets, apertures, or orifices, may provide a rotational force by virtue of wash fluid flowing through the discharge ports. Alternatively, spray arm assemblies 134, 140, 142 may be motor-driven, or may operate using any other suitable drive mechanism. Spray manifolds and assemblies may also be stationary. The resultant movement of the spray arm assemblies 134, 140, 142 and the spray from fixed manifolds provides coverage of dishes and other dishwasher contents with a washing spray. Other configurations of spray assemblies may be used as well. For example, dishwasher 100 may have additional spray assemblies for cleaning silverware, for scouring casserole dishes, for spraying pots and pans, for cleaning bottles, etc. One skilled in the art will appreciate that the embodiments discussed herein are used for the purpose of explanation only and are not limitations of the present subject matter.

In operation, pump 152 draws wash fluid in from sump 138 and pumps it to a diverter assembly 156 (e.g., which may be positioned within sump 138 of dishwasher appliance 100). Diverter assembly 156 may include a diverter disk (not shown) disposed within a diverter chamber 158 for selectively distributing the wash fluid to the spray arm assemblies 134, 140, 142 or other spray manifolds or devices. For example, the diverter disk may have a plurality of apertures that are configured to align with one or more outlet ports (not shown) at the top of diverter chamber 158. In this manner, the diverter disk may be selectively rotated to provide wash fluid to the desired spray device.

According to an exemplary embodiment, diverter assembly 156 is configured for selectively distributing the flow of wash fluid from pump 152 to various fluid supply conduits, only some of which are illustrated in FIG. 2 for clarity. More specifically, diverter assembly 156 may include four outlet ports (not shown) for supplying wash fluid to a first conduit for rotating lower spray arm assembly 134 in the clockwise direction, a second conduit for rotating lower spray arm assembly 134 in the counter-clockwise direction, a third conduit for spraying an auxiliary rack such as the silverware rack, and a fourth conduit for supply mid-level or upper spray assemblies 140, 142 (e.g., such as primary supply conduit 154).

The dishwasher 100 is further equipped with a controller 160 to regulate operation of the dishwasher 100. The controller 160 may include one or more memory devices and one or more microprocessors, such as general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 160 may be constructed without using a microprocessor (e.g., using a combination of discrete analog or digital logic circuitry, such as switches, amplifiers, integrators, comparators, flip-flops, AND gates, and the like) to perform control functionality instead of relying upon software.

The controller 160 may be positioned in a variety of locations throughout dishwasher 100. In the illustrated embodiment, the controller 160 may be located within a control panel area 162 of door 116, as shown in FIGS. 1 and 2. In such an embodiment, input/output ("I/O") signals may be routed between the control system and various operational components of dishwasher 100 along wiring harnesses that may be routed through the bottom of door 116. Typically, the controller 160 may be in operative communication with a user interface panel 164 through which a user may select various operational features and modes and monitor progress of the dishwasher 100. In one embodiment, the user interface 164 may represent a general purpose I/O ("GPIO") device or functional block. In certain embodiments, the user interface 164 includes input components 166, such as one or more of a variety of electrical, mechanical or electromechanical input devices including capacitive touch screens/buttons, rotary dials, push buttons, and touch pads. The user interface 164 may further include one or more display components 168, such as a digital display device or one or more indicator light assemblies designed to provide operational feedback to a user. The user interface 164 may be in communication with the controller 160 via one or more signal lines or shared communication busses.

It should be appreciated that the invention is not limited to any particular style, model, or configuration of dishwasher 100. The exemplary embodiment depicted in FIGS. 1 and 2 is for illustrative purposes only. For example, different locations may be provided for user interface 164, different configurations may be provided for rack assemblies 122, 124, 126, different spray arm assemblies 134, 140, 142 and spray manifold configurations may be used, and other differences may be applied while remaining within the scope of the present subject matter. Moreover, aspects of the present subject matter may be applied to other appliances as well, such as refrigerators, ovens, microwaves, etc.

Referring now generally to FIGS. 1 and 2, door 116 will be described according to exemplary embodiments of the present subject matter. Although door 116 is described herein as being used with dishwasher 100, it should be appreciated that door 116 or variations thereof may be used on any other suitable residential or commercial appliance. As described herein, door 116 may share a coordinate system with dishwasher 100, e.g., when door 116 is in the closed position (e.g., as shown in FIG. 2). Specifically, door 116 may define a vertical direction V, a lateral direction L, and a transverse direction T. Therefore, these directions may be used herein to refer to features of door 116 and its various components and sub-assemblies.

As shown, in the normally closed position, door 116 extends from a top end or top edge 180 to a bottom end or bottom edge 182 along the vertical direction V; from a front end 184 to a rear end 186 along the transverse direction T; and between two lateral ends 188 along the lateral direction L. According to exemplary embodiments, door 116 may be formed from one or more exterior panels that define an interior chamber of door 116. According to exemplary embodiments, the exterior panels of door 116 may be panels that are stamped from stainless steel or may be formed from any other suitably rigid material, such as thermoformed plastic, other metals, etc. In general, the exterior panels of door 116 may be assembled in any suitable manner, e.g., may be secured together using any suitable mechanical fastener, welding, snap-fit mechanisms, etc. In addition, it should be appreciated that an insulating material (not shown), such as fiberglass or foam insulation, may be positioned within door 116 to provide thermal and/or sound insulation to dishwasher 100.

Referring still to FIGS. 1 and 2, user interface panel 164 is positioned proximate top edge 180 of door 116 along the vertical direction V. In this manner, user interface panel 164 may be partially hidden below a countertop when dishwasher appliance 100 is installed below the countertop and door 116 is closed. Accordingly, dishwasher appliance 100 may be referred to as a "top control dishwasher appliance." However, it should be appreciated that aspects of the present subject matter may be used with dishwasher appliances having other configurations or any other suitable appliance. For example, user interface panel 164 may be alternately positioned on front face or front end 184 of door 116.

User interface panel 164 is positioned on door 116 such that a user can engage or interact with user interface panel 164, e.g., to select operating cycles and parameters, activate/deactivate operating cycles, or adjust other operating parameters of dishwasher appliance 100. User interface panel 164 may include a printed circuit board (not shown) that is positioned within door 116. According to exemplary embodiments, printed circuit board may include or be operatively coupled to controller 160 and/or user interface panel 164. In addition, user interface panel 164 may include or be operably coupled to one or more user inputs or touch buttons (e.g., identified generally herein as user inputs 166) for receiving user input, providing user notifications, or illuminating to indicate cycle or operating status.

Specifically, according to the illustrated embodiment, user inputs 166 include a plurality of capacitive sensors that are mounted to user interface panel 164 and are operable to detect user inputs. For example, these capacitive sensors may be configured for triggering when a user touches a top edge 180 of user interface panel 164 in a region associated with a particular user input 166. In particular, these capacitive sensors can detect when a finger or another conductive material with a dielectric different than air contacts or approaches user interface panel 164, along with the precise location, pressure, etc. of the finger interaction.

When a user touches top edge 180 of user interface panel 164 adjacent one of user inputs 166, the associated capacitive sensors may be triggered and may communicate a corresponding signal to controller 160. In such a manner, operations of dishwasher appliance 100 can be initiated and controlled. According to exemplary embodiments, the capacitive sensors may be distributed laterally on user interface panel 164. It will be understood that other any suitable number, type, and position of capacitive sensors may be used while remaining within the scope of the present subject matter. Indeed, any suitable number, type, and configuration of user inputs 166 may be used while remaining within the scope of the present subject matter.

User interface panel 164 may define a plurality of surfaces that are intended to be illuminated for various purposes. For example, user inputs 166 may be illuminated by light sources to inform the user of the location of the button or to provide some other status indication. Notably, this illumination is typically achieved by directing a light beam along the vertical direction V onto top edge 180 of user interface panel 164. Door 116 may further include a plurality of light sources or lighting devices that are configured for illuminating one or more surfaces of user interface panel 164. It should be appreciated that these light sources may include any suitable number, type, configuration, and orientation of light sources mounted at any suitable location to illuminate status indicators or buttons in any suitable colors, sizes, patterns, etc. In other words, the light sources may be provided as any suitable number, type, position, and configuration of electrical light source(s), using any suitable light technology and illuminating in any suitable color. For example, the light sources may include one or more light emitting diodes (LEDs), which may each illuminate in a single color (e.g., white LEDs), or which may each illuminate in multiple colors (e.g., multi-color or RGB LEDs) depending on the control signal from controller 160.

However, it should be appreciated that according to alternative embodiments, the light sources may include any other suitable traditional light bulbs or sources, such as halogen bulbs, fluorescent bulbs, incandescent bulbs, glow bars, a fiber light source, etc. Moreover, the light sources may be operably coupled (e.g., electrically coupled) to controller 160 or another suitable control board to facilitate activation or illumination of the light sources (e.g., to indicate a user input, state of the dishwasher appliance, state of the wash cycle, or any other relevant information to a user).

According to exemplary embodiments, user interface panel 164 may be any suitable transparent or semitransparent feature for diffusing, directing, or otherwise transmitting light from a light source. For example, user interface panel 164 may be formed from a suitable transparent or translucent material configured to direct light energy, such as a dielectric material, such as glass or plastic, polycarbonate, polypropylene, polyacrylic, or any other suitable material.

In addition, user interface panel 164 may be a dead fronted panel. As used herein, the term "dead front" and the like is generally intended to refer to portions of a control panel which may be used as indicators, buttons, interactive control surfaces, or other user-interaction features without exposing the user to the operating side of the equipment or live parts and connections, i.e., lights, electrical connections, etc. For example, user interface panel 164 may include a transparent or translucent body and an opaque masking material that is selectively printed on top edge 180 of the translucent body to define capacitive touch buttons or user inputs 166.

The opaque material may be deposited on the translucent body to define any suitable number, size, and configuration of illuminated features. These illuminated features may be shapes or include other forms such as symbols, words, etc. that are visible on user interface panel 164. More specifically, when light sources are energized, capacitive touch buttons or user inputs 166 on top edge 180 may be illuminated. Thus, the dead fronted top edge 180 may be the surface that is contacted for controlling dishwasher appliance 100 or which may be illuminated for purposes of indicating operating status or other conditions to the user of the dishwasher appliance 100.

Referring still to FIG. 1, a schematic diagram of an external communication system 190 will be described according to an exemplary embodiment of the present subject matter. In general, external communication system 190 is configured for permitting interaction, data transfer, and other communications between dishwasher appliance 100 and one or more external devices. For example, this communication may be used to provide and receive operating parameters, user instructions or notifications, performance characteristics, user preferences, or any other suitable information for improved performance of dishwasher appliance 100. In addition, it should be appreciated that external communication system 190 may be used to transfer data or other information to improve performance of one or more external devices or appliances and/or improve user interaction with such devices.

For example, external communication system 190 permits controller 160 of dishwasher appliance 100 to communicate with a separate device external to dishwasher appliance 100, referred to generally herein as an external device 192. As described in more detail below, these communications may be facilitated using a wired or wireless connection, such as via a network 194. In general, external device 192 may be any suitable device separate from dishwasher appliance 100 that is configured to provide and/or receive communications, information, data, or commands from a user. In this regard, external device 192 may be, for example, a personal phone, a smartphone, a tablet, a laptop or personal computer, a wearable device, a smart home system, or another mobile or remote device.

In addition, a remote server 196 may be in communication with dishwasher appliance 100 and/or external device 192 through network 194. In this regard, for example, remote server 196 may be a cloud-based server 196, and is thus located at a distant location, such as in a separate state, country, etc. According to an exemplary embodiment, external device 192 may communicate with a remote server 196 over network 194, such as the Internet, to transmit/receive data or information, provide user inputs, receive user notifications or instructions, interact with or control dishwasher appliance 100, etc. In addition, external device 192 and remote server 196 may communicate with dishwasher appliance 100 to communicate similar information.

In general, communication between dishwasher appliance 100, external device 192, remote server 196, and/or other user devices or appliances may be carried using any type of wired or wireless connection and using any suitable type of communication network, non-limiting examples of which are provided below. For example, external device 192 may be in direct or indirect communication with dishwasher appliance 100 through any suitable wired or wireless communication connections or interfaces, such as network 194. For example, network 194 may include one or more of a local area network (LAN), a wide area network (WAN), a personal area network (PAN), the Internet, a cellular network, any other suitable short- or long-range wireless networks, etc. In addition, communications may be transmitted using any suitable communications devices or protocols, such as via Wi-Fi®, Bluetooth®, Zigbee®, wireless radio, laser, infrared, Ethernet type devices and interfaces, etc. In addition, such communication may use a variety of communication protocols (e.g., TCP/IP, HTTP, SMTP, FTP), encodings or formats (e.g., HTML, XML), and/or protection schemes (e.g., VPN, secure HTTP, SSL).

External communication system 190 is described herein according to an exemplary embodiment of the present subject matter. However, it should be appreciated that the exemplary functions and configurations of external communication system 190 provided herein are used only as examples to facilitate description of aspects of the present subject matter. System configurations may vary, other communication devices may be used to communicate directly or indirectly with one or more associated appliances, other communication protocols and steps may be implemented, etc. These variations and modifications are contemplated as within the scope of the present subject matter.

Now that the construction of dishwasher appliance 100 and user interface panel 164 according to exemplary embodiments have been presented, an exemplary method 200 of operating a dishwasher appliance will be described. Although the discussion below refers to the exemplary method 200 of operating dishwasher appliance 100, one skilled in the art will appreciate that the exemplary method 200 is applicable to the operation of a variety of other dishwasher appliances, such as front control dishwashers. Moreover, aspects of the present subject matter may be applicable to the operation of any user interface panel on any suitable appliance. In exemplary embodiments, the various method steps as disclosed herein may be performed by controller 160 or a separate, dedicated controller.

Figure 3:
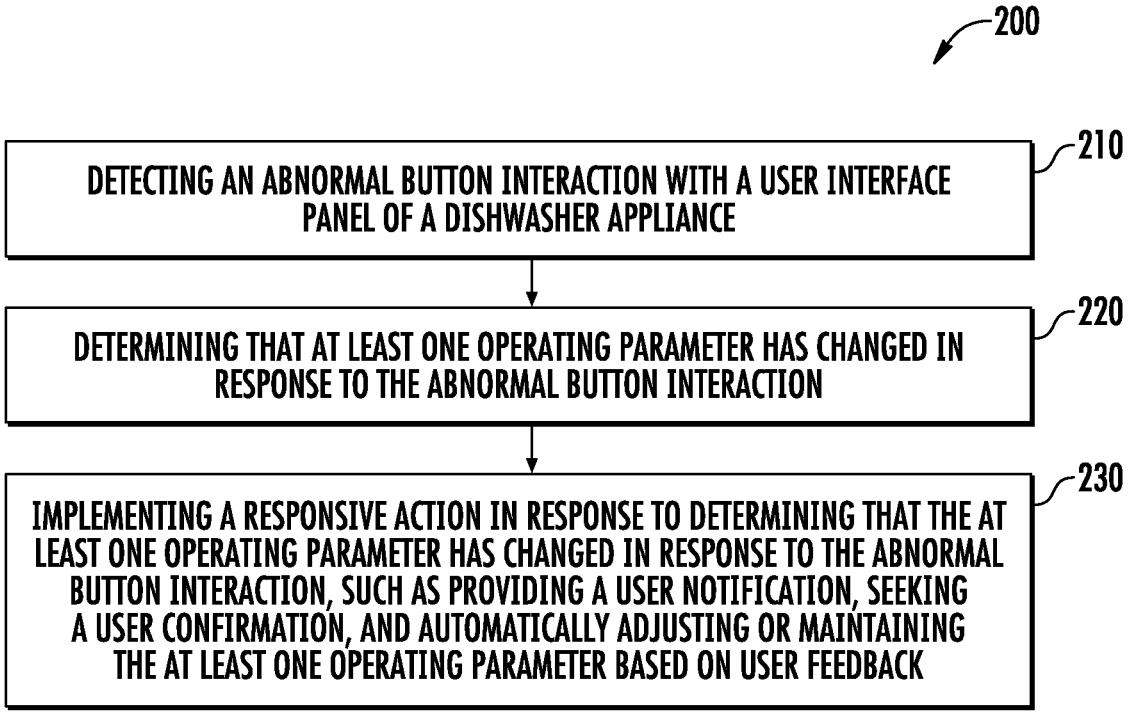
FIG. 3 illustrates a method for responding to abnormal button interactions with a user interface panel of a dishwasher appliance in accordance with one embodiment of the present disclosure.

Referring now to FIG. 3, method 200 includes, at step 210, detecting an abnormal button interaction with a user interface panel of a dishwasher appliance. In this regard, continuing the example from above, interactions with the user interface panel 164 may be continuously monitored by controller 160 of dishwasher appliance 100. During normal operation, a user may press one or more user inputs 166 on user interface panel 164 to select operating cycles, adjust operating parameters, initiate operation, etc. However, as explained briefly above, certain interactions with user interface panel 164 may be considered abnormal, unusual, or potentially unintentional. Accordingly, aspects of the present subject matter are directed to methods for dealing with such abnormal button interactions.

For example, according to exemplary embodiments, detecting the abnormal button interaction may include measuring a button interaction time and determining that the button interaction time falls outside of a predetermined time range. In this regard, for example, controller 160 may monitor or may be programmed with button interaction times associated with normal appliance operation. For example, a user may typically press a button for a specific duration, and controller 160 may associate that duration or a specific range around that duration as the predetermined time range.

In this regard, for example, the predetermined time range may be between about 10 milliseconds and 2 seconds, between about 50 milliseconds and 1.5 seconds, between about 100 milliseconds and 1 second, between about 200 milliseconds and 800 milliseconds, between about 400 milliseconds and 600 milliseconds, or any other suitable time range. If the button interaction time falls outside of the predetermined time range, controller 160 may determine that the button interaction was abnormal. Other suitable button interaction time ranges are possible and within the scope of the present subject matter.

For example, if the button is pressed for a very brief time period, such as 5 milliseconds, controller 160 may trigger the abnormal button interaction, e.g., as this may be indicative of an unintentional tap of a finger, brushing a hand, or brief contact with another object. Similarly, if the button is pressed for a relatively long period of time, such as greater than two seconds, this may be indicative of a user leaning on user interface panel 164 or another interaction not intended to result in a user input or parameter change. Accordingly, controller 160 may again determine this interaction is an abnormal button interaction.

According to exemplary embodiments, detecting the abnormal button interaction may include determining that the abnormal button interaction comprises simultaneously pressing multiple buttons on the user interface panel. In this regard, for example, a typical user input would include a single finger touching a single button for a specific time and with a specific pressure. Variations on the interaction time and pressure may be indicative of an abnormal button interaction. In addition, if multiple buttons are pressed simultaneously, the controller may consider this an abnormal button interaction. For example, if two adjacent user inputs 166 are simultaneously touched or activated, this may indicate that the user was wishing to push only one of those buttons or that a user was leaning against the user interface panel 164.

According to still other embodiments, detecting the abnormal button interaction may include determining that the abnormal button interaction includes predetermined sequence of button presses on the user interface panel. For example, if controller 160 senses that a series of user inputs 166 have been activated in a sequential manner going from left to right on user interface panel 164, this may indicate that a user unintentionally swiped their hand or finger across user interface panel 164. Alternatively, this interaction may be indicative of liquid splashing along the user interface panel 164 or another object interacting with user interface panel 164. In these situations, controller 160 may consider the interaction abnormal and may raise the abnormal button interaction flag. Although exemplary abnormal button interactions are described herein, it should be appreciated that additional abnormal button interactions may be used while remaining within scope the present subject matter.

After the abnormal button interaction has been detected at step 210, step 220 may include determining that at least one operating parameter has changed in response to the abnormal button interaction. As used herein, the terms "operating parameter" and the like are generally intended to refer to any cycle setting, operating time, component setting, input parameter, cycle selection, control actions, or other operating characteristic that may affect the performance of dishwasher appliance 100. Other operating parameter adjustments are possible and within the scope of the present subject matter. Step 220 may include controller 160 determining that any such operating parameter has changed as a result of the abnormal button interaction.

Step 230 may generally include implementing a responsive action in response to determining that the at least one operating parameter has changed in response to the abnormal button interaction. In this regard, for example, if controller 160 has detected that an interaction with user interface panel 164 is not normal, and thus potentially not intended to change any operating parameters, but nonetheless has also detected a change in operating parameter, step 230 may include automatically responding to such a change. For example, step 230 may include reverting back to the prior operating parameter settings, i.e., before the abnormal button interaction resulted in a change in such operating parameters.

According to an exemplary embodiment, implementing the responsive action may include providing a user notification that the at least one operating parameter has changed in response to the abnormal button interaction. In this manner, controller 160 may make the user of dishwasher appliance 100 aware of the situation such that they may take corrective action. It should be appreciated that controller 160 may communicate with the user of dishwasher appliance 100 in any suitable manner. For example, controller 160 may be in operative communication with a remote device through an external network (e.g., such as remote device 192). For example, the user notification may be provided through the remote device which may include a mobile phone, a smart speaker, a tablet, or any other suitable device.

According to exemplary embodiments, implementing the responsive action may include seeking a user confirmation or approval as to the detected abnormal button interaction. In this regard, for example, method 200 may include receiving a user confirmation that the abnormal button interaction was intentional and implementing an operating cycle in accordance with the change in the at least one operating parameter. For example, when an abnormal button interaction is detected, controller 160 may notify the user (e.g., via display 168 or remote device 192) as to the button selection and that it was flagged as abnormal. The user may review the button selection and may confirm that it was intended and should be implemented. In response, controller 160 may implement the abnormal button interaction.

By contrast, implementing the responsive action may include receiving a user confirmation that the abnormal button interaction was unintentional and adjusting the at least one operating parameter to a prior parameter setting in response. In this regard, if the user is informed of the abnormal button interaction and responds that it was inadvertent or unintentional, controller 160 and disregard the abnormal button interaction, may revert any changed parameter settings back to their prior setting, or may reverse or correct any other action taken in response to the abnormal button interaction.

Figure 4:
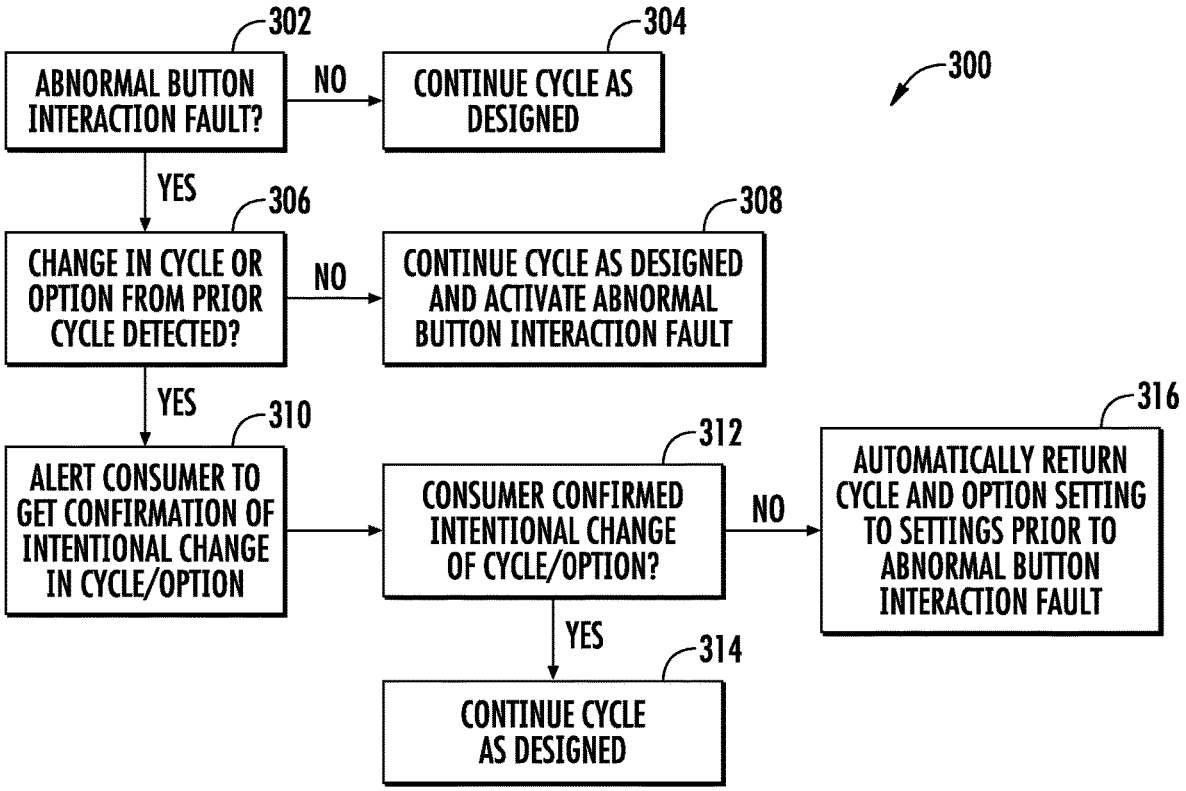
FIG. 4 provides a flow diagram illustrating an exemplary process for responding to abnormal button interactions according to an exemplary embodiment of the present subject matter.

Referring now briefly to FIG. 4, an exemplary process for responding to abnormal button interactions 300 that may be implemented by dishwasher appliance 100 will be described according to an exemplary embodiment of the present subject matter. According to exemplary embodiments, method 300 may be similar to or interchangeable with method 200 and may be implemented by controller 160 of dishwasher appliance 100. In addition, it should be appreciated that the process for responding to abnormal button interactions 300 may be used within any other suitable appliance.

As shown, at step 302, controller 160 may determine whether there has been an abnormal button interaction with user interface panel 164. If the button interaction is considered normal, step 304 may include continuing the cycle as designed, e.g., in accordance with the user input. By contrast, if the button interaction is deemed abnormal, step 306 may include determining whether there was a change in the cycle, options, or cycle parameters from the prior operating cycle. If there was no change in operating parameters, step 308 may include continuing the cycle as designed. In this regard, if the abnormal button interaction results in no change in operating parameters and thus no difference in the appliance operation, controller 160 may perform the operating cycle without interacting with the user.

By contrast, if the abnormal button interaction is detected (e.g., at step 302) and there is a change in the operating parameters (e.g., at step 306), step 310 may include providing a user notification or otherwise alerting the consumer to seek confirmation and inform them of the change in operating parameters. Step 312 may include seeking user confirmation regarding the intentionality of the abnormal button interaction. If the user indicates that the abnormal button interaction was in fact intentional, step 314 may include implementing the abnormal button interaction and continuing the cycle as designed. By contrast, if the user indicates that the abnormal button interaction was unintentional, step 316 may include automatically returning the cycle and option settings to the settings used prior to the abnormal button interaction.

FIGS. 3 and 4 depict steps performed in a particular order for purposes of illustration and discussion. Those of ordinary skill in the art, using the disclosures provided herein, will understand that the steps of any of the methods discussed herein can be adapted, rearranged, expanded, omitted, or modified in various ways without deviating from the scope of the present disclosure. Moreover, although aspects of method 200 and method 300 are explained using dishwasher appliance 100 as an example, it should be appreciated that this method may be applied to the operation of any suitable consumer or commercial appliance.

As explained above, aspects of the present subject matter are generally directed to methods for detecting unintentional interactions with a user interface panel of a dishwasher appliance and correcting appliance operation accordingly. For example, the methods may include maintaining the same cycle and option settings for a dishwasher operating cycle whenever an unintentional change in the appliance settings is detected. In this regard, for example, dishwasher appliances may include capacitance touch controls that may be inadvertently pressed or activated, e.g., due to interaction with hands, shins, pets, etc. These interactions may unintentionally change cycle and option settings. Aspects of the present subject matter are directed to detecting such unintentional interactions and implementing a desired response.

Inadvertent or unintentional interactions may be detected in any suitable manner. For example, the amount of time that a button is actuated can be significantly different for these unintentional activations as compared to normal button selection. By detecting interaction times that may be associated with unintentional activation of a cycle or change of an operating parameter, the dishwasher may not take the directed action and may instead generate a fault code or user notification. If an abnormal consumer interaction with a capacitive touch button is detected, the appliance may check to see if the cycle and option selections were changed during this abnormal button interaction. If there was an abnormal button interaction and a change in cycle/option selection resulted from such abnormal button interaction, then the user may be alerted and asked if the change was intentional. If the user confirms the change was intentional, the new settings may be updated, whereas the dishwasher may automatically return to the prior settings if the user confirms the interaction was unintentional.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwasher appliance defining a vertical direction, a lateral direction, and a transverse direction, the dishwasher appliance comprising:

a wash tub positioned within a cabinet and defining a wash chamber;

a door pivotally mounted to the cabinet to provide selective access to the wash chamber;

a user interface panel mounted to the door; and a controller in operative communication with the user interface panel, the controller being configured to:

detect an abnormal button interaction with the user interface panel, wherein detecting the abnormal button interaction comprises measuring a button interaction duration and determining that the button interaction duration falls outside a predetermined time range;

determine that at least one operating parameter has changed in response to the abnormal button interaction; and implement a responsive action in response to determining that the at least one operating parameter has changed in response to the abnormal button interaction.

2. The dishwasher appliance of claim 1, wherein detecting the abnormal button interaction with the user interface panel comprises:

determining that the abnormal button interaction comprises simultaneously pressing multiple buttons on the user interface panel.

3. The dishwasher appliance of claim 1, wherein detecting the abnormal button interaction with the user interface panel comprises:

determining that the abnormal button interaction includes a predetermined sequence of button presses on the user interface panel.

4. The dishwasher appliance of claim 1, wherein implementing the responsive action comprises:

providing a user notification that the at least one operating parameter has changed in response to the abnormal button interaction.

5. The dishwasher appliance of claim 4, wherein the user notification is provided through the user interface panel.

6. The dishwasher appliance of claim 4, wherein the controller is in operative communication with a remote device through an external network, and wherein the user notification is provided through the remote device.

7. The dishwasher appliance of claim 6, wherein the remote device comprises at least one of a mobile phone or a smart speaker.

8. The dishwasher appliance of claim 1, wherein implementing the responsive action comprises:

receiving a user confirmation that the abnormal button interaction was intentional; and implementing an operating cycle in accordance with the change in the at least one operating parameter.

9. The dishwasher appliance of claim 1, wherein implementing the responsive action comprises:

receiving a user confirmation that the abnormal button interaction was unintentional; and adjusting the at least one operating parameter to a prior parameter setting.

10. The dishwasher appliance of claim 1, wherein the user interface panel is positioned on a top surface of the door or on a front surface of the door.

11. The dishwasher appliance of claim 1, wherein the user interface panel comprises capacitance touch controls being operable to detect user inputs via contact with the user interface panel.

12. A method of operating a dishwasher appliance, the dishwasher appliance comprising a user interface panel mounted to a door, the method comprising:

detecting an abnormal button interaction with the user interface panel, wherein detecting the abnormal button interaction comprises measuring a button interaction duration and determining that the button interaction duration falls outside a predetermined time range;

determining that at least one operating parameter has changed in response to the abnormal button interaction; and implementing a responsive action in response to determining that the at least one operating parameter has changed in response to the abnormal button interaction.

13. The method of claim 12, wherein detecting the abnormal button interaction with the user interface panel comprises:

determining that the abnormal button interaction comprises simultaneously pressing multiple buttons or includes a predetermined sequence of button presses on the user interface panel.

14. The method of claim 12, wherein implementing the responsive action comprises:

providing a user notification that the at least one operating parameter has changed in response to the abnormal button interaction.

15. The method of claim 14, wherein the user notification is provided through the user interface panel.

16. The method of claim 14, wherein the user notification is provided through a remote device.

17. The method of claim 12, wherein implementing the responsive action comprises:

receiving a user confirmation that the abnormal button interaction was intentional; and implementing an operating cycle in accordance with the change in the at least one operating parameter.

18. The method of claim 12, wherein implementing the responsive action comprises:

receiving a user confirmation that the abnormal button interaction was unintentional; and adjusting the at least one operating parameter to a prior parameter setting.

* * * * *